US006169872B1

(12) United States Patent
Thayer

(10) Patent No.: US 6,169,872 B1
(45) Date of Patent: Jan. 2, 2001

(54) ELECTROSTATIC CLEANING BELT BRUSH

(75) Inventor: Bruce E. Thayer, Webster, NY (US)

(73) Assignee: Xerox Corporation, Stamford, CT (US)

( * ) Notice: Under 35 U.S.C. 154(b), the term of this patent shall be extended for 0 days.

(21) Appl. No.: 09/407,757

(22) Filed: Sep. 28, 1999

(51) Int. Cl.[7] ..... G03G 21/00
(52) U.S. Cl. ..... 399/354
(58) Field of Search ..... 399/352, 353, 399/354

(56) References Cited

U.S. PATENT DOCUMENTS 4,320,774 3/1982 Rogers .
4,457,615 7/1984 Seanor .
5,381,218 1/1995 Lundy .
5,523,824 * 6/1996 Sahay et al. ..... 399/149
5,576,822 * 11/1996 Lindblad et al. ..... 399/354
6,073,294 * 6/2000 Mashtare et al. ..... 15/1.51

FOREIGN PATENT DOCUMENTS 6-301319 * 10/1994 (JP) .

* cited by examiner

*Primary Examiner*—Robert Beatty
(74) *Attorney, Agent, or Firm*—Linda M. Robb

(57) ABSTRACT

An electrically biased cleaning belt brush removes oppositely biased particles from a surface. The belt brush, which is entrained about supporting members, includes a substrate to which is attached a multiplicity of conductive brush fibers. Particles adhering to the conductive fibers are removed from the brush fibers at a detoning station. The cleaning belt brush is biased to alternating regions of positive and negative polarities.

21 Claims, 4 Drawing Sheets

ELECTROSTATIC CLEANING BELT BRUSH

BACKGROUND OF THE INVENTION

This invention relates generally to an electrostatographic printer or copier, and more particularly concerns a flexible belt cleaning apparatus used therein.

In an electrophotographic application such as xerography, a charge retentive surface (ie., photoconductor, photoreceptor or imaging surface) is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. Contacting the latent image with a finely divided electrostatically attractable powder referred to as "toner" develops the image. Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. This process is well known, and useful for light lens copying from an original, and printing applications from electronically generated or stored originals, where a charged surface may be image-wise discharged in a variety of ways. Ion projection devices where a charge is image-wise deposited on a charge retentive substrate operate similarly.

Although a preponderance of the toner forming the image is transferred to the paper during transfer, some toner invariably remains on the charge retentive surface, it being held thereto by relatively high electrostatic and/or mechanical forces Additionally,paper fibers, Kaolin and other debris have a tendency to be attracted to the charge retentive surface. It is essential for optimum operation that the toner remaining on the surface be cleaned thoroughly therefrom.

A commercially successful mode of cleaning employed on automatic xerographic devices utilizes a brush with soft conductive fiber bristles or with insulative soft bristles which have suitable triboelectric characteristics. While the bristles are soft for the insulative brush, they provide sufficient mechanical force to dislodge residual toner particles from the charge retentive surface. In the case of the conductive brush, the brush is usually electrically biased to provide an electrostatic force for toner detachment from the charge retentive surface. The fixed radius of commonly used brushes can limit cleaning applications. Toner particles adhere to the fibers (ie. bristles) of the brush after the charge retentive surface has been cleaned. The process of removing toner from these types of cleaner brushes can be accomplished in a variety of ways. Typically, brush cleaners use flicker bars to provide the detoning function which may not sufficiently clean the particles from the brush fibers.

Although electrostatic brush cleaners have proved quite successful, high volume electrostatographic printer or copier applications require higher process speeds and the ability to clean with production color requirements. These requirements include high process speeds, higher toner input masses into the cleaner, better cleaning in a color process than in black and white, and the production printing desire to print to the edge of the page, which leaves untransferred toner densities around the edge of the document which must be cleaned in a single pass through the cleaner.

The cleaning ability of an electrostatic brush cleaner is a function of the number of fibers which are available to clean toner from the photoreceptor and the quantity of toner which can be held by each fiber, as well as the charge on the toner particles and the bias on the fibers. The toner charge and the brush bias can be controlled by preclean corona treatment and brush bias power supplies The number of fibers available to clean toner from the photoreceptor, known as fiber strikes, is a function of brush speed, brush interference to the photoreceptor, brush size, weave density and pile height. The amount of toner which can be held on the tip of a fiber during the cleaning process is a function of the fiber diameter, interference to the photoreceptor, toner charge and fiber bias. As a patch of toner enters the cleaning nip the brush fibers mechanically dislodge the toner from the photoreceptor and electrostatically attract and adhere the toner particles to the fibers. As the fiber proceeds through the cleaning nip, more toner particles are cleaned and electrostatically adhere to the fiber forming what is known as a match head. As the thickness of the match head increases, the electrostatic forces available to hold additional charged toner particles decreases. This is due to the physical spacing of the particles from the biased fiber and the like charge of the toner particles already adhered to the fiber. The match head will cease to increase in size when the electrostatic attractive forces are no longer strong enough to hold dislodged toner particles. At this point the fiber has reached its toner capacity and no further cleaning takes place. Additional toner remaining on the photoreceptor surface will pass through the cleaning nip creating a cleaning failure if all of the available fibers have reached their toner holding capacity.

For an electrostatic brush cleaner which has been optimized for toner charge and brush bias, and which has exceeded the capacity of the fibers to clean toner due to the level of the toner input to the cleaner, the only remaining remedy is to increase the number of fibers available for cleaning. This may be accomplished by adding additional electrostatic brushes biased to the appropriate polarity. Although a multiple brush cleaner would, with enough brushes, be able to clean any desired toner input, such a cleaner would require more space along the photoreceptor belt than would be available and would create additional drag on the photoreceptor belt. To meet high volume printer and copier applications, an electrostatic belt cleaner, which will provide enhanced cleaning capability within available space requirements and without imposing excessive photoreceptor belt drag is needed.

The following disclosures may be relevant to various aspects of the present invention and may be briefly summarized as follows:

U.S. Pat. No. 3,795,025 to Sadamitsu discloses an apparatus for cleaning an electrophotographic photoreceptor. The apparatus includes a pair of brushes rotating in opposite directions. The rotating brushes are enclosed in a brush box and a vacuum system removes toner from the brushes and the inside of the brush box.

U.S. Pat. No. 4,320,774 to Rogers discloses a mechanical toothbrush with a brush drive unit coupled to a rotating device such as an electric motor. The brush drive unit alternately rotates a first belt brush in a first direction while maintaining a second belt brush in a substantially fixed position and rotates the second belt brush in a second direction while maintaining the first belt brush in a substantially fixed position.

U.S. Pat. No. 4,457,615 to Seanor discloses a belt brush constructed of alternate conductive and non-conductive segments, which causes one conductive segment which is being used for charging to be electrically isolated from another conductive segment which is being used for cleaning. Different voltages can be simultaneously applied to each of the segments without adversely affecting the operation of the other. A single detoning roller is provided to remove toner particles from the brush.

U.S. Pat. No. 4,878,093 to Edmunds discloses a dual roll cleaning apparatus. A cleaning housing, which is connected to a vacuum, supports an upstream brush roll cleaner and a downstream foam or poromeric roll cleaner. The brush roll cleaner provides a primary cleaning function, while the foam roll cleaner provides a secondary back up cleaning function.

U.S. Pat. No. 4,999,679 to Corbin et al discloses an apparatus for cleaning a photoconductive surface. The apparatus includes a pair of oppositely electrically biased cleaning brushes. Each brush is located in a separate housing with each housing electrically biased to the same polarity as the brush located therein.

U.S. Pat. No. 5,257,079 to Lange et aL discloses an apparatus for removing discharged particles from an imaging surface. The apparatus includes an electrostatic brush with an AC bias followed by either a DC biased brush as a secondary cleaner or an insulative brush.

U.S. Pat. No. 5,381,218 to Lundy discloses a conductive flexible cleaner brush belt having a plurality of detoning stations to remove particles from the brush fibers. At least one of the rollers about which the flexible belt brush is mounted has a small diameter for spreading the brush fibers apart. The spreading of the fibers creates a node affect as the fibers rebound, with adjacent fibers opening to create a moving node affect. An air vacuum removes the particles from the brush fibers.

SUMMARY OF THE INVENTION

Briefly stated, and in accordance with one aspect of the present invention, there is provided an apparatus for cleaning particles from a surface. The apparatus includes a flexible belt brush, which includes a substrate and a multiplicity of conductive brush fibers extending outwardly therefrom. The belt brush may be electrically biased to a single or to dual polarities. A supporting device movably supports the flexible belt brush and brings the conductive fibers into contact with the surface for removal of particles therefrom. A detoning device cooperates with the belt brush to remove particles therefrom. The belt brush is electrically biased.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
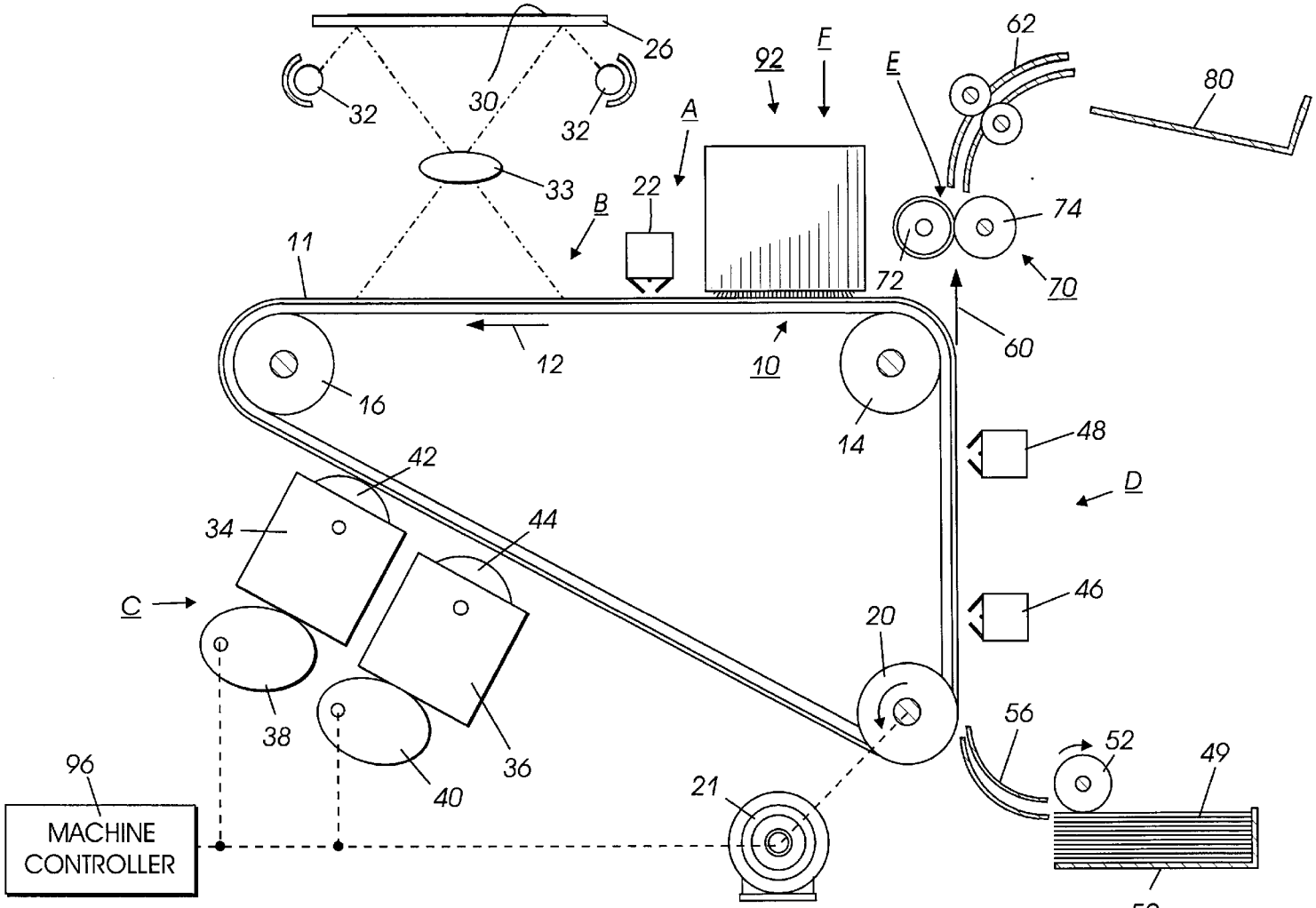
FIG. 1 is a schematic illustration of a printing apparatus incorporating the inventive features of the present invention.

For a general understanding of an electrophotographic printer or copier, in which the present invention may be incorporated, reference is made to FIG. 1, which depicts schematically the various components thereof. Hereinafter, like reference numerals will be employed throughout to designate identical elements. Although the dual polarity electrostatic belt cleaner apparatus of the present invention is particularly well adapted for use in an electrophotographic printing machine, it should become evident from the following discussion that it is equally well suited for use in other applications and is not necessarily limited to the particular embodiment shown herein.

Referring now to the drawings, the various processing stations employed in the reproduction machine illustrated in FIG. 1 will be described briefly hereinafter. It will no doubt be appreciated that the various processing elements also find advantageous use in electrophotographic printing applications from an electronically stored original, and with appropriate modifications, to an ion projection device which deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers, which rotate freely as the belt 10 moves in the direction of arrow 12.

With continued reference to FIG. 1, initially a portion of the belt 10 passes through charging station A. At charging station A, a corona device 22 charges a portion of the photoreceptor belt 10 to a relatively high, substantially uniform potential, either positive or negative.

At exposure station B, an original document 30 is positioned face down on a transparent platen 26 for illumination with flash lamps 32. Light rays reflected from the original document are reflected through a lens 33 and projected onto the charged portion of the photoreceptor belt 10 to selectively dissipate the charge thereon. This records an electrostatic latent image, which corresponds to the informational area contained within the original document, onto the belt. Alternatively, a laser may be provided to image-wise discharge the photoreceptor in accordance with stored electronic information.

Thereafter, the belt 10 advances the electrostatic latent image to developing station C. At development station C, either developer housing 34 or 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (ie. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed image to transfer station D. At transfer station D, a sheet of support material such as paper copy sheets is advanced into contact with the developed images on the belt 10. A corona generating device 46 charges the copy sheet to the proper potential so that it becomes tacked to the photoreceptor belt 10 and the toner powder image is attracted from the photoreceptor belt 10 to the sheet. After transfer, the corona generator 48 charges the copy sheet to an opposite polarity to de-tack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60, to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F. The cleaning apparatus of the present invention is represented by the reference numeral 92, which will be described in greater detail in FIG. 2. Removed residual particles may also be stored for disposal A machine controller 96 is preferably a known programmable controller or combination of controllers, which conventionally control all of the machine steps and functions described above. The controller 96 is responsive to a variety of sensing devices to enhance control of the machine, and also provides connection diagnostic operations to a user interface (not shown) where required.

Figure 2:
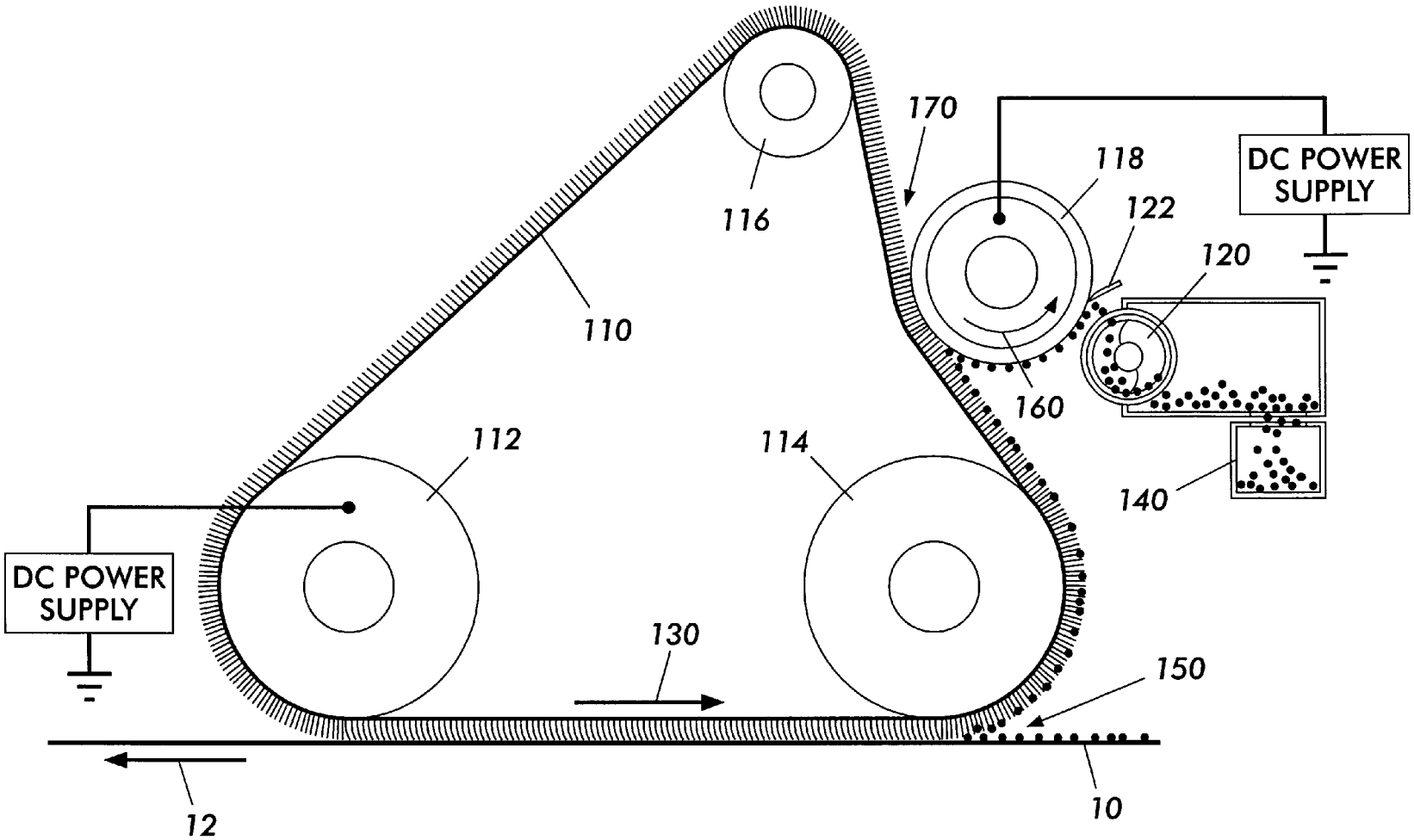
FIG. 2 is an elevational view of the present invention.
Figure 3:
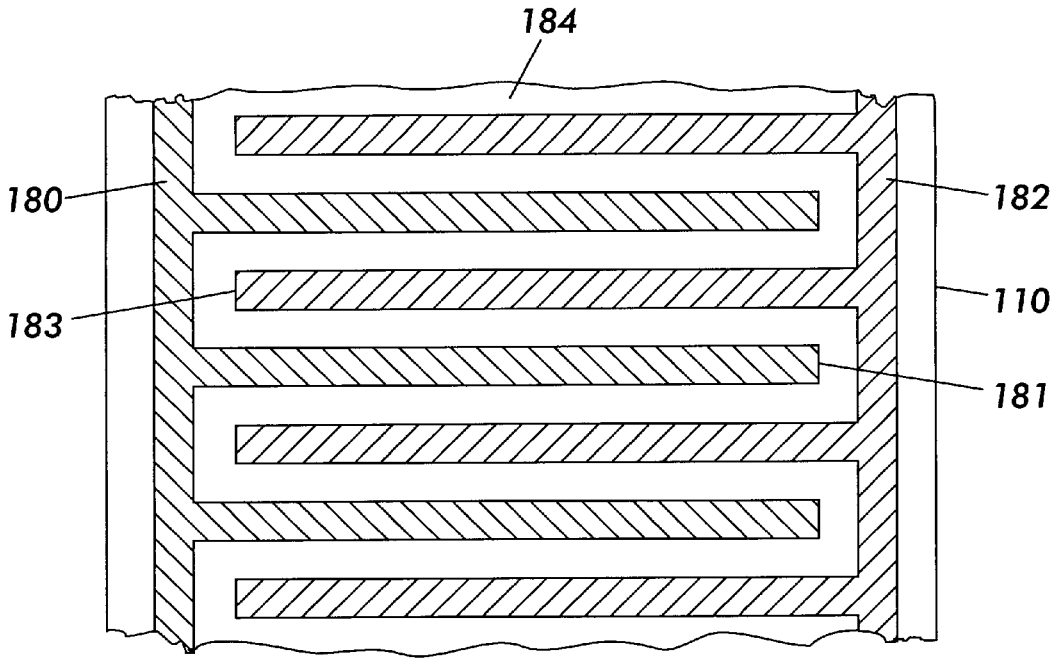
FIG. 3 is a section view of the belt of the present invention.
Figure 4:
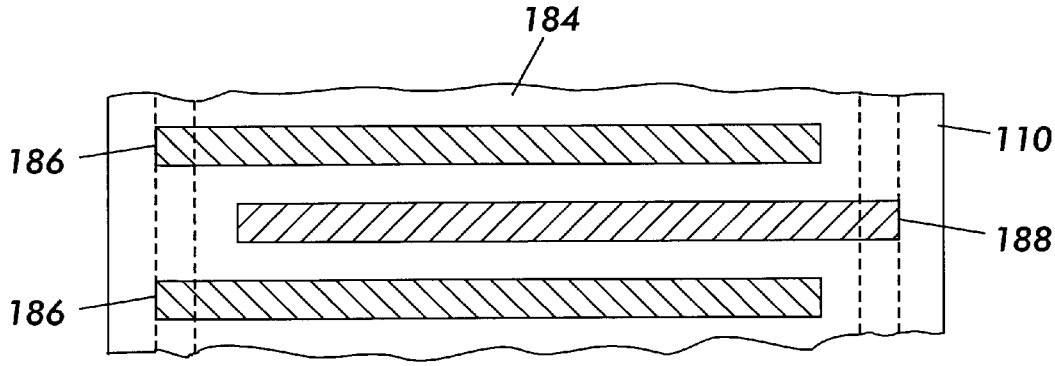
FIG. 4 is a section view of an alternative embodiment of the belt of the present invention.

As thus described, a reproduction machine in accordance with the present invention may be any of several well-known devices. Variations may be expected in specific electrophotographic processing, paper handling and control arrangements without effecting the present invention. However, it is believed that the foregoing description is sufficient for purposes of the present application to illustrate the general operation of an electrophotographic printing machine, which exemplifies one type of apparatus employing the present invention therein. Reference is now made to FIGS. 2–4, where the showings are for the purpose of illustrating preferred embodiments of the present invention and not for limiting the same.

Removal of charged dielectric particles adhered to a dielectric surface can be accomplished by mechanical, electrical or electromechanical means. The electrostatic belt brush cleaner employs a combination of electrical and mechanical forces to detach and remove toner particles from the photoreceptor surface.

Reference is now made to FIG. 2, which shows an elevational view of the preferred embodiment of the present invention. The flexible belt brush 110 is shown in operable condition in contact with photoreceptor belt 10 through extended cleaning nip 150. Flexible belt brush 110 is electrically biased to suitable magnitude and polarity and is comprised of a continuous loop of conductive backing material (e.g. urethane or polyester) to which conductive brush fibers are attached. The flexible belt brush 110 is entrained about three rollers 112, 114, and 116, one of which is a drive roller, and moving in direction 130 opposed to the movement of photoreceptor belt 10. The two rollers 112 and 114 support the belt 110 in brushing contact with photoreceptor belt 10. The third roller 116 supports belt 110 as the conductive brush fibers are brought into contact with electrostatic detoning roll 118, which is biased to a greater polarity than the belt brush and is rotating in direction 160 opposed to movement of belt 110. Although entraining the belt brush about three rollers is suitable for many applications, it is understood that some applications may require a plurality of support rollers. Such plurality of support rollers is included within the spirit and scope of the present invention as defined by the appended claims.

In order to exert an electrostatic force on the toner particles, the toner particles are charged using a preclean corona device and an electric potential is applied to the conductive fibers of the brush. This potential creates an electric field between the fibers and the ground plane of the photoreceptor. The force experienced by the toner particles must exceed the adhesion force between the toner particles and the photoreceptor surface in order to detach the particles. The electrical force, when combined with the mechanical (deflection) forces of the fibers, detaches and removes charged toner particles from the photoreceptor surface. Although biasing the brush belt to a single polarity is suitable for many applications, high volume printing or copying applications may require that the belt be produced such that there are regions of reversing polarization along the length of the belt. In such applications both positive and negative polarities are applied to the alternating regions of polarity along the length of the belt.

Reference is now made to FIG. 3, which shows a section of belt 110 with such regions of alternating positive and negative polarity. The ability to bias multiple sections of the cleaning belt independently enables replacement of two oppositely biased brushes with a single belt brush. Due to the narrow cleaning nip of a brush, it is very difficult to provide enough fiber strikes of each polarity within the constraints of a reasonably small diameter brush. In contrast to the narrow cleaning nip of a brush, the belt brush of the present invention provides an extended cleaning nip 150 which enables adequate fibers of each polarity to be present in the cleaning nip. Space between the oppositely biased regions of the belt may also be provided for electrical isolation. As illustrated in FIG. 3, an electrical source biases section 181 of belt 110 to a negative polarity through connecting bias strip 180 and a similar source biases section 183 of belt 110 to a positive polarity through connecting bias strip 182. Section 184 electrically isolates sections 181 and 183 from each other.

Alternatively, the connecting edge bias strip may be eliminated as illustrated in FIG. 4. Sections of negative polarity 188 and sections of positive polarity 186 have offset ends, which may be independently biased by any known means. Section 184 electrically isolates sections 186 and 188 from each other. The pattern of alternating positive and negative biases illustrated in FIGS. 3 and 4 are intended as examples of possible patterns for biasing a belt brush. It will be evident to one skilled in the art that many alternatives, modifications, and variations are possible to achieve the desired result. Accordingly, the patterns for allowing alternating electrical biasing in a brush belt presented herein are intended to embrace all such modifications and variations which fall within the spirit and scope of the appended claims Referring again to FIG. 2, in operation, as a negative toner particle enters the cleaning nip 150 it is dislodged from the photoreceptor belt 10 and adheres to a positive biased fiber attached to belt 110. The positive biased fibers transport the toner particles to the more positively biased detoning roll 118. As the brush fibers of belt 110 come into contact with detoning roll 118, the negative toner particles then transfer from the belt 110 to detoning roll 118. The rotating detoning roll 118 then transports the toner particles to the detoning blade 122 that scrapes the toner particles off the detoning roll 118 and into an auger 120. The auger 120 transports the toner particles to a waste container.

Figure 5:
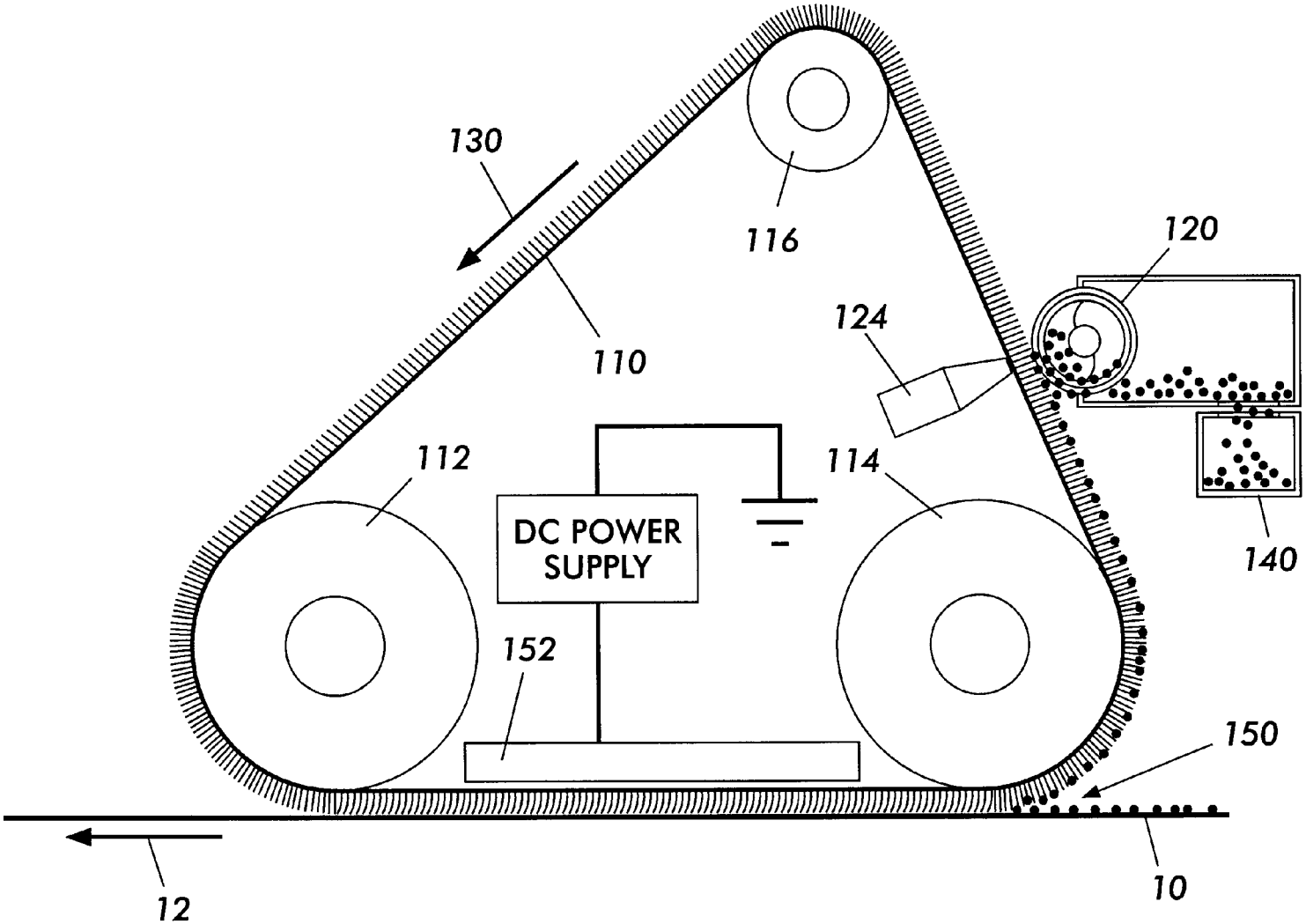
FIG. 5 is an elevational view of an alternative embodiment of the present invention.

Reference is now made to FIG. 5, which shows an alternate embodiment of the present invention. As in the preferred embodiment, the flexible belt brush 110 is in operable contact with photoreceptor belt 10 through extended cleaning nip 150. Flexible belt brush 110 is electrically biased to suitable magnitude and polarity and is comprised of a continuous loop of conductive backing material to which conductive brush fibers are attached. The flexible belt brush 110 is entrained about three rollers 112, 114, and 116, one of which is a drive roller, and moving in direction 130 opposed to the movement of photoreceptor belt 10. The two rollers 112 and 114 support the belt 110 in brushing contact with photoreceptor belt 10. A backer bar 152, which may be electrically biased, may apply pressure to the belt to maintain constant brushing contact between the photoreceptor belt 10 and belt brush 110 through the cleaning nip 150. The third roller 116 supports belt 110 as the conductive brush fibers are brought into contact with electrostatic detoning roll 118, which is biased to a greater polarity than the belt brush and is rotating in direction 160 opposed to movement of belt 110.

In operation, as a negative toner particle enters the cleaning nip 150 it is dislodged from the photoreceptor belt 10 and adheres to a positive biased fiber attached to belt 110. The positive biased fibers transport the toner particles past an acoustic transducer and horn 124, which apply high frequency vibrational energy to the fibers of the belt brush 110 to dislodge toning particles. Although it is possible to dislodge the toner particles through the use of acoustic vibrational energy alone, a flicker bar, which is not shown, may assist in dislodging toner particles. The dislodged toner particles are collected by auger 120 or a vacuum device, which is not shown but is known in the art, and transported to waste container 140. Alternatively, the toner particles loosened by acoustic transducer 124 may transfer to a detoning roll, which transports the toner particles to a detoning blade that scrapes the particles off the detoning roll and into an auger, which transports the toner particles to a waste container, as illustrated in FIG. 2.

It is therefore apparent that there has been provided, in accordance with the present invention, an electrostatic belt cleaner that fully satisfies the aims and advantages set forth hereinabove. While this invention has been described in conjunction with a specific embodiment thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

What is claimed:

1. An apparatus for cleaning particles from a surface, comprising:

a flexible belt brush including a belt substrate and a multiplicity of conductive fibers extending outwardly therefrom with the fibers contacting a surface for removal of particles therefrom;

a supporting device for movably supporting said belt brush in extended contact with the surface;

a detoning device, cooperating with said belt brush, to remove particles from said belt brush to ensure sufficient cleaning of said belt brush; and means for electrically biasing said belt brush to alternating regions of positive and negative polarity.

2. The apparatus according to claim 1, wherein said supporting device comprises a plurality of supports, said belt brush entrained about said plurality of supports.

3. The apparatus according to claim 1, wherein said detoning device comprises:

a detoning roll;

a detoning blade adjacent to said detoning roll to remove particles from said detoning roll;

an auger to collect the particles removed from said detoning roll; and a waste toner chamber positioned to receive the particles being transported by said auger.

4. The apparatus according to claim 3, further including an acoustic transducer and horn.

5. The apparatus according to claim 3, wherein said detoning roll contacts said belt brush.

6. The apparatus according to claim 3, further including means for electrically biasing said detoning roll.

7. The apparatus according to claim 1, wherein said detoning device comprises:

an acoustic transducer;

a horn adjacent to said acoustic transducer;

an auger to collect the particles loosened from said flexible belt brush; and a waste toner chamber positioned to receive the particles being transported by said auger.

8. The apparatus according to claim 7, further comprising a flicker bar which contacts said conductive fibers of said belt brush as said belt brush moves past said acoustic transducer.

9. The apparatus according to claim 1, further comprising means for moving said belt brush at a predetermined velocity.

10. The apparatus according to claim 1, wherein the surface includes a photoconductive surface.

11. The apparatus according to claim 2, wherein said supporting device further includes a backer bar.

12. An electrostatographic printing machine comprising:

a photoreceptor having a photoconductive surface;

a charging station for charging said photoconductive surface to a predetermined potential;

an exposure station for exposing said photoconductive surface to produce a latent image thereon;

a development station for depositing development material on said charge retentive surface;

a transfer station for transfer of said development material adhered to said latent image onto print media;

a fusing station for fusing of said latent image onto said print media; and a cleaning station for removal of said development material remaining on said charge retentive surface after fusing, said cleaning station including: a flexible belt brush including a belt substrate and a multiplicity of conductive fibers extending outwardly therefrom, a supporting device for movably supporting said belt brush, a detoning device to remove particles from said belt brush, and means for electrically biasing said belt brush to alternating regions of positive and negative polarity.

13. The printing machine according to claim 12, wherein said supporting device comprises a plurality of supports having said belt entrained thereabout.

14. The printing machine according to claim 12, wherein said detoning device comprises:

a detoning roll;

a detoning blade adjacent to said detoning roll to remove particles from said detoning roll;

an auger to collect the particles removed from said detoning roll; and a waste toner chamber positioned to receive the particles being transported by said auger.

15. The apparatus according to claim 14, further including an acoustic transducer and horn.

16. The apparatus according to claim 14, wherein said detoning roll contacts said belt brush.

17. The apparatus according to claim 14, further including means for electrically biasing said detoning roll.

18. The printing machine according to claim 12, wherein said detoning device comprises:

an acoustic transducer;

a horn adjacent to said acoustic transducer;

an auger to collect the particles loosened from said flexible belt brush; and a waste toner chamber positioned to receive the particles being transported by said auger.

19. The apparatus according to claim 18, further comprising a flicker bar which contacts said conductive fibers of said belt brush as said belt brush moves past said acoustic transducer.

20. The printing machine according to claim 12, further comprising means for moving said belt brush at a predetermined velocity.

21. The printing machine according to claim 13, wherein said supporting device further comprises a backer bar.

* * * * *